US009878189B2

(12) United States Patent
Lee et al.

(10) Patent No.: US 9,878,189 B2
(45) Date of Patent: Jan. 30, 2018

(54) SOLID AEROSOL DETONATOR AND FIRE EXTINGUISHING APPARATUS USING THE SAME

(71) Applicant: Chang Sung Ace Co., Ltd., Seongnam (KR)

(72) Inventors: Yeu Yong Lee, Seoul (KR); Jong Hee Han, Seoul (KR)

(73) Assignee: CHANG SUNG ACE CO., LTD., Seongnam-si (KR)

( * ) Notice: Subject to any disclaimer, the term of this patent is extended or adjusted under 35 U.S.C. 154(b) by 0 days.

(21) Appl. No.: 15/430,921

(22) Filed: Feb. 13, 2017

(65) Prior Publication Data

US 2017/0232282 A1 Aug. 17, 2017

(30) Foreign Application Priority Data

Feb. 12, 2016 (KR) ..... 10-2016-0016214

(51) Int. Cl.
*A62C 5/00* (2006.01)
*A62C 19/00* (2006.01)
*A62C 99/00* (2010.01)

(52) U.S. Cl.
CPC ..... *A62C 5/006* (2013.01); *A62C 19/00* (2013.01); *A62C 99/0018* (2013.01)

(58) Field of Classification Search
CPC ..... A62C 5/00; A62C 5/006; A62C 13/20; A62C 13/22; A62C 13/76; A62C 19/00; A62C 99/0018
See application file for complete search history.

(56) References Cited

U.S. PATENT DOCUMENTS 6,116,348 A * 9/2000 Drakin ..... A62C 5/006 169/12
2007/0246229 A1* 10/2007 Gross ..... A62C 5/006 169/12
2009/0301738 A1* 12/2009 Gross ..... A62C 5/006 169/30
2010/0065285 A1* 3/2010 Guo ..... A62C 5/006 169/9

(Continued)

FOREIGN PATENT DOCUMENTS

KR 10-0932097 12/2009
KR 10-1158342 6/2012
KR 10-1243081 3/2013

*Primary Examiner* — Darren W Gorman
(74) *Attorney, Agent, or Firm* — Lex IP Meister, PLLC

(57) ABSTRACT

Disclosed herein is a solid aerosol detonator capable of generating a fire extinguishing gas by vaporizing an internal solid fire extinguishing agent in order to extinguish a fire which may be generated in a place to live or an industrial place and a fire extinguishing apparatus using the same. The solid aerosol detonator and the fire extinguishing apparatus using the same can be detonated using only a fire extinguishing agent of a solid form without using an electronic match or an ignition agent, that is, a material coated on an electrical percussion. Accordingly, the combustion action of a solid aerosol can be stably generated because the solid aerosol detonator and the fire extinguishing apparatus using the same are not sensitive to a change in the physical properties and a change in the temperature even after a lapse of a specific time.

9 Claims, 5 Drawing Sheets

(56) References Cited

U.S. PATENT DOCUMENTS

| | | | | |
|---|---|---|---|---|
| 2012/0061109 | A1* | 3/2012 | Pavesi | A62C 17/00<br>169/46 |
| 2014/0196916 | A1* | 7/2014 | Lee | A62C 5/006<br>169/28 |

* cited by examiner

SOLID AEROSOL DETONATOR AND FIRE EXTINGUISHING APPARATUS USING THE SAME

CROSS-REFERENCES TO RELATED APPLICATION

This application claims priority to Korean Patent Application No. KR 10-2016-0016214 filed on Feb. 12, 2016, the contents of which are incorporated herein by reference.

BACKGROUND OF THE INVENTION

1. Technical Field

The present invention relates generally to a solid aerosol detonator and a fire extinguishing apparatus using the same and, more particularly, to a solid aerosol detonator capable of generating a fire extinguishing gas by vaporizing an internal solid fire extinguishing agent in order to extinguish a fire which may be generated in a place to live or an industrial place and a fire extinguishing apparatus using the same.

2. Description of the Related Art

In general, a solid aerosol fire extinguishing apparatus includes a fire extinguishing agent, a coolant and an ignition device. The fire extinguishing agent generates a fire extinguishing component when the ignition device combusts the fire extinguishing agent in response to an external operating signal or by an operating system. In this case, the fire extinguishing component is sprayed to the outside through a cooling layer due to pressure of gas generated along with the generated fire extinguishing component. The sprayed fire extinguishing component is applied to a place where a fire must be extinguished, and extinguishes the fire by blocking a material that causes the fire.

More specifically, in the solid aerosol fire extinguishing apparatus, the fire extinguishing gas generated by combustion has a solid form having a particle diameter of 1~5 μm. The solid aerosol fire extinguishing apparatus has advantages in that it has an excellent fire extinguishing power compared to a known fire extinguishing system and a contaminated area can be easily cleaned after the fire extinguishing apparatus was used because residues are not left over, and thus it is very useful from a viewpoint of a user.

Furthermore, the solid aerosol fire extinguishing apparatus is very effective in a fire location where water cannot be used. Accordingly, the apparatus is widely applied to places including poor conditions, such as an electrical panel in a factory, an oil-related fire in a restaurant, an expensive electronic device and the inside of a vessel.

Such a conventional technology includes the following prior arts: Korean Patent No. 10-0806066 entitled "Fire-extinguishing agent for aerosol fire extinguisher and method for preparing the agent", Korean Utility Model No. 20-0447025 entitled "Electrical operating-type solid aerosol automatic extinguisher", Korean Utility Model No. 20-0447030 entitled "Thermal-detective operation device including fusible metal, and solid-aerosol automatic extinguisher including the same", Korean Patent No. 10-0932097 entitled "Electrically-operating solid-aerosol automatic extinguisher including lateral outlet", Korean Patent No. 10-0932099 entitled "Electrically solid-aerosol automatic extinguisher including lateral outlet" and Korean Utility Model No. 20-0452293 entitled "Solid-aerosol automatic extinguished."

However, in accordance with the fire extinguishing apparatus of the prior arts, when an external operating signal is received, an electronic match, that is, a material coated on an electrical percussion, generates explosion by generating an electric spark and explosion is generated in another ignition agent again. Such a configuration has a disadvantage in that the combustion operation of a solid aerosol is irregularly generated due to a change in the physical properties and a change in the temperature after a lapse of a specific time.

Furthermore, the electronic match provides heat in a temporary explosive form in which it operates by a temporary electric spark, and an internal solid aerosol is not perfectly combusted because a sufficient heating temperature and time is not provided to the internal fire extinguishing agent. Accordingly, there is a problem in that a sufficient fire extinguishing gas for extinguishing a fire is not generated.

Furthermore, there is a disadvantage in that heating means for providing heat to a solid aerosol depending on the loading state of the solid aerosol is separated or detached due to a small impact because the heating means is coupled to the outside of the fire extinguishing apparatus. Furthermore, there is a problem in that an effect of extinguishing a fire is poor because a circuit board or an electric wire may be melted by heat attributable to a fire extinguishing gas of a high temperature although the heating means is located within the fire extinguishing apparatus.

Accordingly, there is a need for continued research for solving the conventional problems.

SUMMARY OF THE INVENTION

Accordingly, the present invention has been made keeping in mind the above problems occurring in the conventional art, and an object of the present invention is to provide a solid aerosol detonator capable of stably providing a combustion temperature using only a solid aerosol fire extinguishing agent without using a fire extinguishing method by explosion, such as an electronic match or an ignition agent, and a fire extinguishing apparatus using the same.

Another object of the present invention is to provide a solid aerosol detonator, which can induce an internal solid aerosol to be perfectly combusted and generate a sufficient fire extinguishing gas for extinguishing a fire by providing a sufficient heating temperature and time to an internal fire extinguishing agent, and a fire extinguishing apparatus using the same.

Yet another object of the present invention is to provide a solid aerosol detonator capable of protecting heating means against an external impact because the heating means is located within the fire extinguishing apparatus and of preventing a circuit board or an electric wire from being melted and damaged due to heat attributable to a fire extinguishing gas of a high temperature and a fire extinguishing apparatus using the same.

In accordance with an aspect of the present invention, there are provided a solid aerosol detonator inserted into the enclosure of a solid aerosol fire extinguishing apparatus, including a first plate configured to partition the internal space of the enclosure, a first through hole being formed at the center of the first plate; a second plate configured to have a diameter smaller than the diameter of the first plate, seated on a top surface of the first plate and configured to form a specific space between the outer circumferential surface of the second plate and the inner wall of the enclosure, a second through hole being formed at the center of the second plate; a power supply unit configured to store specific power and located under the first plate; a heat-generating unit connected to the power supply unit, upward protruded from the second plate through the first through hole and second through hole, supplied with power from the power supply unit, and heated at a specific temperature; a first fire extinguishing agent configured to surround the outer circumferential surface of the heat-generating unit in such a way as to impregnate a specific portion of the heat-generating unit and detonated at an ignition point or more to generate a fire extinguishing gas; a sealed member configured to surround the outer circumferential surface of the first fire extinguishing agent; and a second fire extinguishing agent configured to have a ring shape in which a through hole is formed at the center of the second fire extinguishing agent and detonated at an ignition point or more to generate a fire extinguishing gas, the second fire extinguishing agent being seated on the second plate while surrounding the outer circumferential surface of the sealed member, wherein the second plate includes a seating stage seated on a top surface of the first plate and a coupling stage of a cylindrical shape upward protruded from the central part of the seating stage and inserted into the through hole of the second fire extinguishing agent, and a second through hole is formed at the center of the seating stage and coupling stage so that the seating stage and coupling stage communicate with each other, and a fire extinguishing apparatus including a solid aerosol detonator.

Furthermore, the power supply unit includes a battery configured to store specific power and a switch connected to the battery and configured to turn on/off an electric current flowing into the heat-generating unit.

Furthermore, the heat-generating unit includes a hot wire or resistant configured to generate heat at the ignition point or more of the first fire extinguishing agent in response to an electric current of a specific intensity or more, a terminal coupled to the power supply unit, and a connection line to which the terminal and the hot wire or resistant are connected.

Furthermore, the first fire extinguishing agent and second fire extinguishing agent includes a solid aerosol filling. The first fire extinguishing agent is compressed in the form of power having a diameter of 100~1000 mesh and filled into the inside of the sealed member.

Furthermore, the sealed member includes a sealant including one selected from porous films made of non-woven fabric, Korean paper, parchment paper and fabrics.

The solid aerosol detonator further includes a metal mesh network configured to surround the outer circumferential surface of the sealed member.

The solid aerosol detonator further includes a third plate closely attached to a top surface of the second fire extinguishing agent and fixed to the inner sidewall of the enclosure, wherein a mesh structure is formed at the central part of the third plate.

The solid aerosol detonator further includes a heat shield material filled under the first plate in such a way as to surround the outer circumferential surface of the power supply unit.

BRIEF DESCRIPTION OF THE DRAWINGS

The above and other objects, features and advantages of the present invention will be more clearly understood from the following detailed description taken in conjunction with the accompanying drawings, in which.

Figure 1:
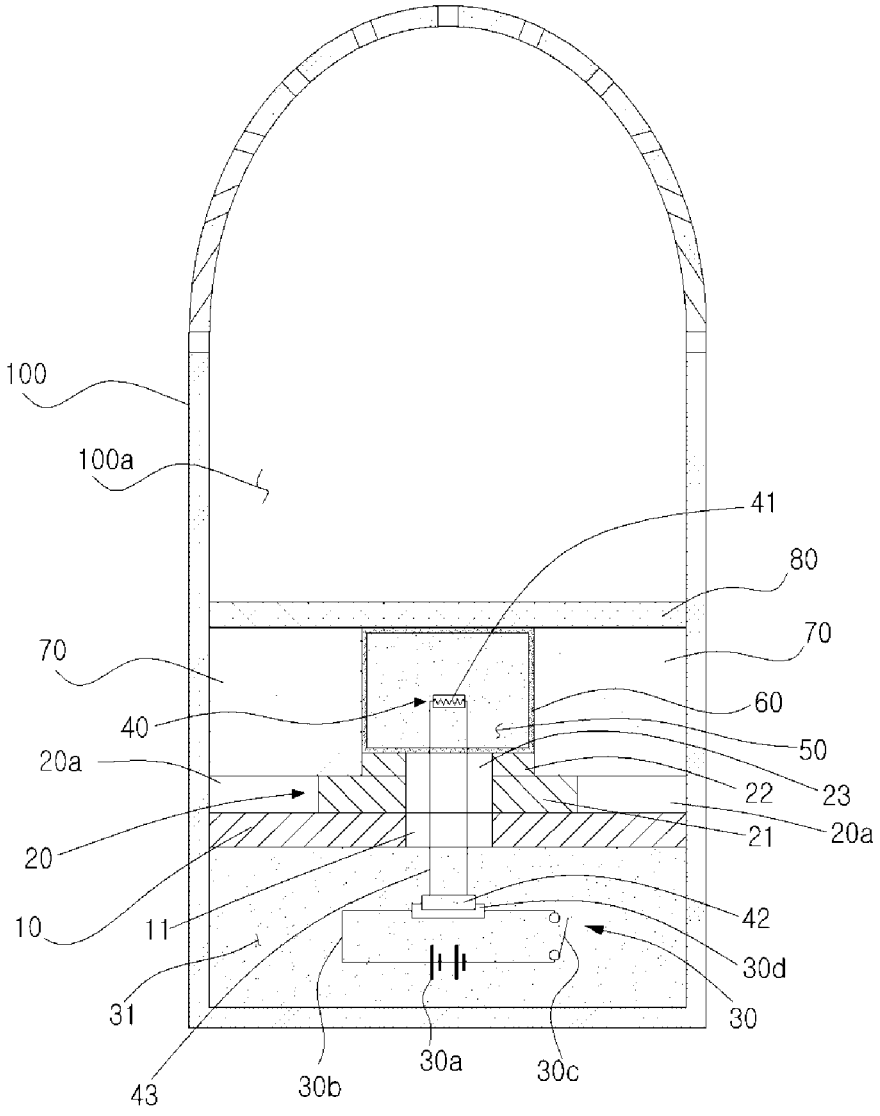
FIG. 1 is a cross-sectional view of a solid aerosol detonator according to an embodiment of the present invention.

| <Description of reference numerals in the drawings> | |
|---|---|
| 100: enclosure | |
| 10: first plate hole | 11: first through |
| 20: second plate | 21: seating stage |
| 22: coupling stage | 23: second through hole |
| 30: power supply unit | 31: heat shield material |
| 30a: battery | 30b: electric wire |
| 30c: switch | 30d: socket |
| 40: heat-generating unit | 41: hot wire/a resistant |
| 42: terminal | 43: connection line |
| 50: first fire extinguishing agent | |
| 60: sealed member | 61: mesh network |
| 70: second fire extinguishing agent | |
| 71: through hole | 80: third plate |
| 1: solid aerosol detonator | 2: coolant |
| 3: spray hole | |

DESCRIPTION OF THE PREFERRED EMBODIMENTS

Hereinafter, a solid aerosol detonator according to an embodiment of the present invention is described in detail with reference to the accompanying drawings.

First, in assigning reference numerals to elements in the drawings, the same reference numerals denote the same elements throughout the drawings even in cases where the elements are shown in different drawings. Furthermore, a detailed description of the known functions and configurations will be omitted if it is deemed to make the gist of the present invention unnecessarily vague. Furthermore, directional terms, such as the "upper side", the "lower side", the "front" and the "back", are described in relation to the orientation of the illustrated drawing. Since the elements according to an embodiment of the present invention may be positioned in various directions, the directional terms are used for only illustrative purposes and are not intended to limit the present invention.

Figure 2:
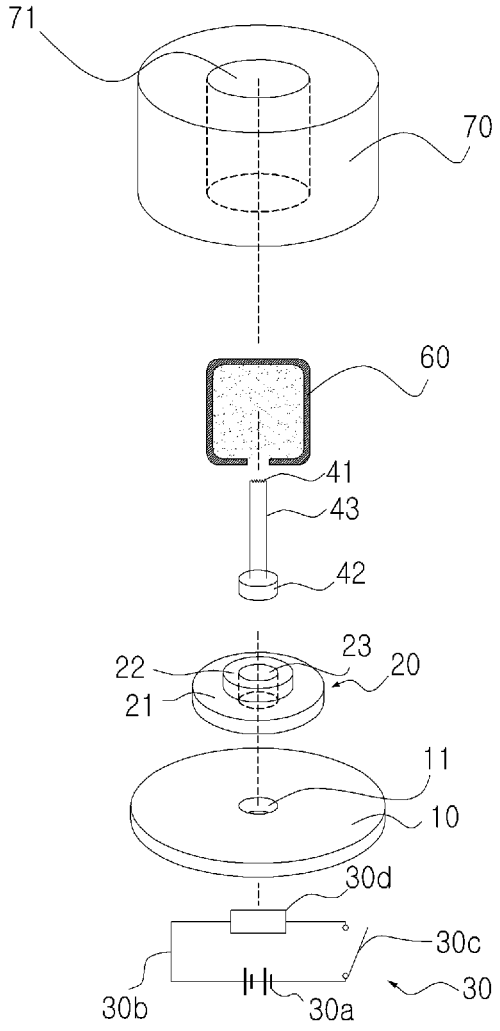
FIG. 2 is an exploded cross-sectional view of the solid aerosol detonator according to an embodiment of the present invention.

FIG. 1 is a cross-sectional view of a solid aerosol detonator according to an embodiment of the present invention, and FIG. 2 is an exploded cross-sectional view of the solid aerosol detonator according to an embodiment of the present invention.

As shown in FIGS. 1 and 2, the solid aerosol detonator according to an embodiment of the present invention is disposed within the enclosure 100 of a solid aerosol fire extinguishing apparatus, and generates a fire extinguishing gas of a haze form by detonating a solid aerosol fire extinguishing agent.

More specifically, the solid aerosol detonator is inserted into the enclosure 100 that forms an internal space so that the solid aerosol detonator is separated from the outside of the solid aerosol fire extinguishing apparatus. The solid aerosol detonator includes a first plate 10, a second plate 20, a power supply unit 30, a heat-generating unit 40, a first fire extinguishing agent 50, a sealed member 60 and a second fire extinguishing agent 70, which are combined to form a single detonator.

The first plate 10 is a disc form and made of a metallic material. The first plate 10 is located inside the enclosure 100 and formed to have the same diameter as the inner circumferential diameter of the enclosure 100, and partitions the internal space 100*a*. Furthermore, a first through hole 11 is formed at the center of the first plate 10 so that the partitioned internal spaces 100*a* are connected. In an embodiment of the present invention, an example in which the first through hole 11 is formed to have a size through which the heat-generating unit 40 can pass is described below.

Furthermore, the second plate 20 has a disc form smaller than the diameter of the first plate 10. The second plate 20 is seated on a top surface of the first plate 10, and forms a specific space 20*a* between the outer circumferential surface of the second plate 20 and the inner wall of the enclosure.

Furthermore, a second through hole 23 that communicates with the first through hole 11 is formed at the center of the second plate 20.

In the present embodiment, the second through hole 23 may be formed to have a size through which the heat-generating unit 40 can pass while communicating with the first through hole 11.

More specifically, the second plate 20 includes a seating stage 21 of a disc form seated on the top surface of the first plate 10 and a coupling stage 22 of a cylindrical shape upward protruded from the central part of the seating stage 21 and inserted into the through hole 71 of the second fire extinguishing agent 70. The second through hole 23 is formed at the center of the seating stage 21 and coupling stage 22 so that the second through hole 23 communicates with the first through hole 11.

The power supply unit 30 is located under the first plate 10 and functions to store specific power.

More specifically, the power supply unit 30 includes a battery 30*a* configured to have specific power stored therein and a switch 30*c* connected to the battery 30*a* by an electric wire 30*b* and configured to turn on/off an electric current flowing along the electric wire 30*b*.

In this case, the switch 30*c* is turned on/off in order to shut or open an electric current according to an external mechanism. An operating method of the switch 30*c* can be sufficiently implemented using various conventional switches, and a detailed description thereof is omitted.

In this case, the solid aerosol detonator further includes a heat shield material 31 that surrounds the outer circumferential surface of the power supply unit 30. The heat shield material 31 is located under the first plate 10, and can prevent damage attributable to an external impact or heat of a high internal temperature.

The heat-generating unit 40 is connected to the power supply unit 30, and is supplied with power from the power supply unit 30 and heated at a specific temperature. The heat-generating unit 40 is configured to be protruded upward from the second plate 20 through the first through hole 11 and second through hole 23.

In the present embodiment, the heat-generating unit 40 includes a hot wire or resistant 41 heated at a specific temperature by an electric current of a specific intensity or more at the one end and a terminal 42 coupled to the power supply unit 30 at the other end. The hot wire or resistant 41 is connected to the terminal 42 by a connection line 43.

That is, the terminal 42 is connected to the power supply unit 30. In this case, the connection line 43 is upward protruded from the second plate 20 through the first through hole 11 and the second through hole 23, and the hot wire or resistant 41 is formed at the end of the connection line 43.

In this case, the socket 30*d* of the power supply unit 30 to which the terminal 42 is connected is connected to the electric wire 30*b*.

The first fire extinguishing agent 50 is a solid aerosol filling which is detonated at a temperature of an ignition point or more and generates a fire extinguishing gas. The first fire extinguishing agent 50 has a powder form having a diameter of 100~1000 mesh.

The sealed member 60 is a sealant, that is, one of porous films made of non-woven fabric, Korean paper, parchment paper and fabrics.

In the present embodiment, the inside of the sealed member 60 is filled with the first fire extinguishing agent 50 in a powder form.

Thereafter, part of the hot wire or resistant 41 and connection line 43 of the heat-generating unit 40 is impregnated at the center of first fire extinguishing agent 50 that fills the inside of the sealed member 60.

That is, the first fire extinguishing agent 50 of a powder form is loaded within the sealed member 60 and part of the heat-generating unit 40 is impregnated in the first fire extinguishing agent 50, thereby forming a single sealing material structure.

Figure 4:
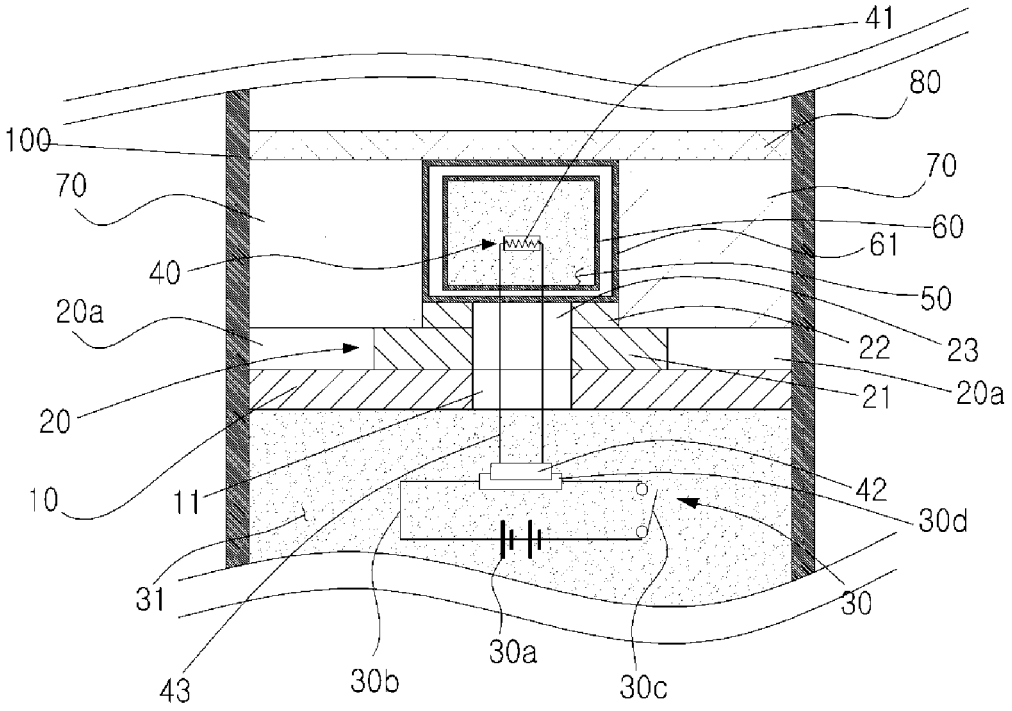
FIG. 4 is an enlarged cross-sectional view of a solid aerosol detonator according to an embodiment of the present invention.

FIG. 4 is an enlarged cross-sectional view of a solid aerosol detonator according to an embodiment of the present invention. A mesh network 61 made of a metallic material may be surrounded on the outer circumferential surface of the sealed member 60 made of a sealing material. More specifically, the mesh network 61 is made of a metallic material and has specific strength and structural hardness. The first fire extinguishing agent 50 surrounded by the sealed member 60 may be seated over the second plate 20 and can maintain a specific form.

The second fire extinguishing agent 70 is detonated at a temperature of an ignition point or more and generates a fire extinguishing gas. The second fire extinguishing agent 70 has a ring shape having the through hole 71 formed at the central part thereof so that the sealed member 60 onto which the first fire extinguishing agent 50 has been loaded is inserted into the central part of the second fire extinguishing agent 70 to form an integrated type.

More particularly, the second fire extinguishing agent 70 is closely attached to the outer circumferential surface of the sealed member 60 and surrounded thereby. Accordingly, the coupling stage 22 of the second plate 20 is seated in the through hole 71 of the second fire extinguishing agent 70, and thus the second fire extinguishing agent 70 is closely attached to the seating stage 21 and can then be fixed to the second plate 20.

A solid aerosol filling including the same component as the first fire extinguishing agent 50 may be used as the second fire extinguishing agent 70.

An operation of the solid aerosol detonator described above according to an embodiment of the present invention is described below.

Figure 3:
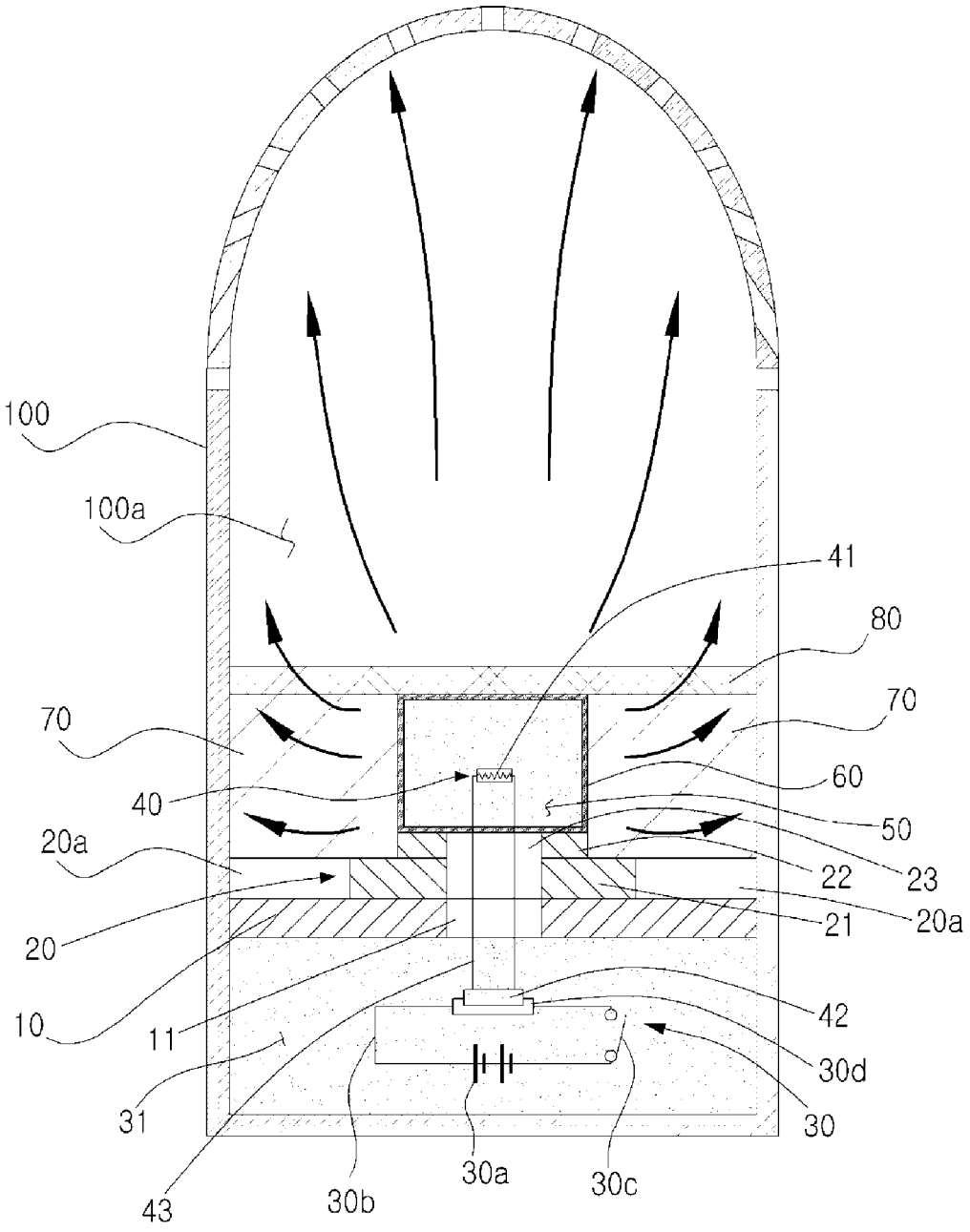
FIG. 3 is a state diagram showing that the solid aerosol detonator according to an embodiment of the present invention operates.

FIG. 3 is a state diagram showing that the solid aerosol detonator according to an embodiment of the present invention operates. The first fire extinguishing agent 50 is vaporized by heat generated by the heat-generating unit 40 that is driven by power supplied by the power supply unit 30, thus generating a fire extinguishing gas.

At this time, the fire extinguishing gas passes through the sealing member 60 from the inside thereof to the outside thereof. The passing of the fire extinguishing gas through the sealing member 60 is limited. Accordingly, the fire extinguishing gas generated by the first fire extinguishing agent 50 passes through the sealing member 60 at a high temperature and a high-pressure state due to internal pressure of the sealing member 60. At this time, the second plate 20 may function to seal the fire extinguishing gas generated by the first fire extinguishing agent 50 so that the fire extinguishing gas is not downward directed.

That is, since the second plate 20 closes the lower side of the first fire extinguishing agent 50, damage to the power supply unit 30 on the lower side attributable to the fire extinguishing gas of a high temperature and high pressure, which is generated by the first fire extinguishing agent 50, can be prevented.

Next, the fire extinguishing gas generated by the first fire extinguishing agent 50 passes through the sealing member 60 laterally and meets the second fire extinguishing agent 70. At this time, the fire extinguishing gas of a high temperature high pressure which has been generated by the first fire extinguishing agent 50 and passed through the sealed member 60 provides heat to the second fire extinguishing agent 70 while passing through the second fire extinguishing agent 70 without being sprayed as soon as it is generated. Accordingly, the second fire extinguishing agent 70 is continuously detonated.

At this time, the heat of the fire extinguishing gas generated by the first fire extinguishing agent 50 may be transferred to the bottom of the second fire extinguishing agent 70, but air necessary for detonation may not be easily supplied to the heat. At this time, the specific space 20*a* formed by the second plate 20 provides air necessary for the detonation of the second fire extinguishing agent 70 because it can store a specific amount of air, and can also prevent the heat of a fire extinguishing gas generated by the second fire extinguishing agent 70 from being directly thermally copied to the first plate 10.

Next, the fire extinguishing gas generated by the first fire extinguishing agent 50 and the fire extinguishing gas generated by the second fire extinguishing agent 70 are sprayed from the inside of the enclosure 100 to the outside thereof, thus being capable of extinguishing a fire.

The solid aerosol detonator may further include a third plate 80 fixed to the inner sidewall of the enclosure 100. More specifically, the third plate 80 is closely attached to the top surface of the second fire extinguishing agent 70 to fix the second fire extinguishing agent 70, and may have a mesh structure formed at a central part thereof in order to transmit a generated fire extinguishing gas to the outside of the enclosure 100.

Accordingly, while the first fire extinguishing agent 50 and second fire extinguishing agent 70 are vaporized, the third plate 80 can prevent the second fire extinguishing agent 70 from being deviated from the inside of the enclosure 100 by supporting the second fire extinguishing agent.

As described above, the solid aerosol detonator according to an embodiment of the present invention may be inserted into the enclosure 100 of a fire extinguishing apparatus and used in the fire extinguishing apparatus.

Figure 5:
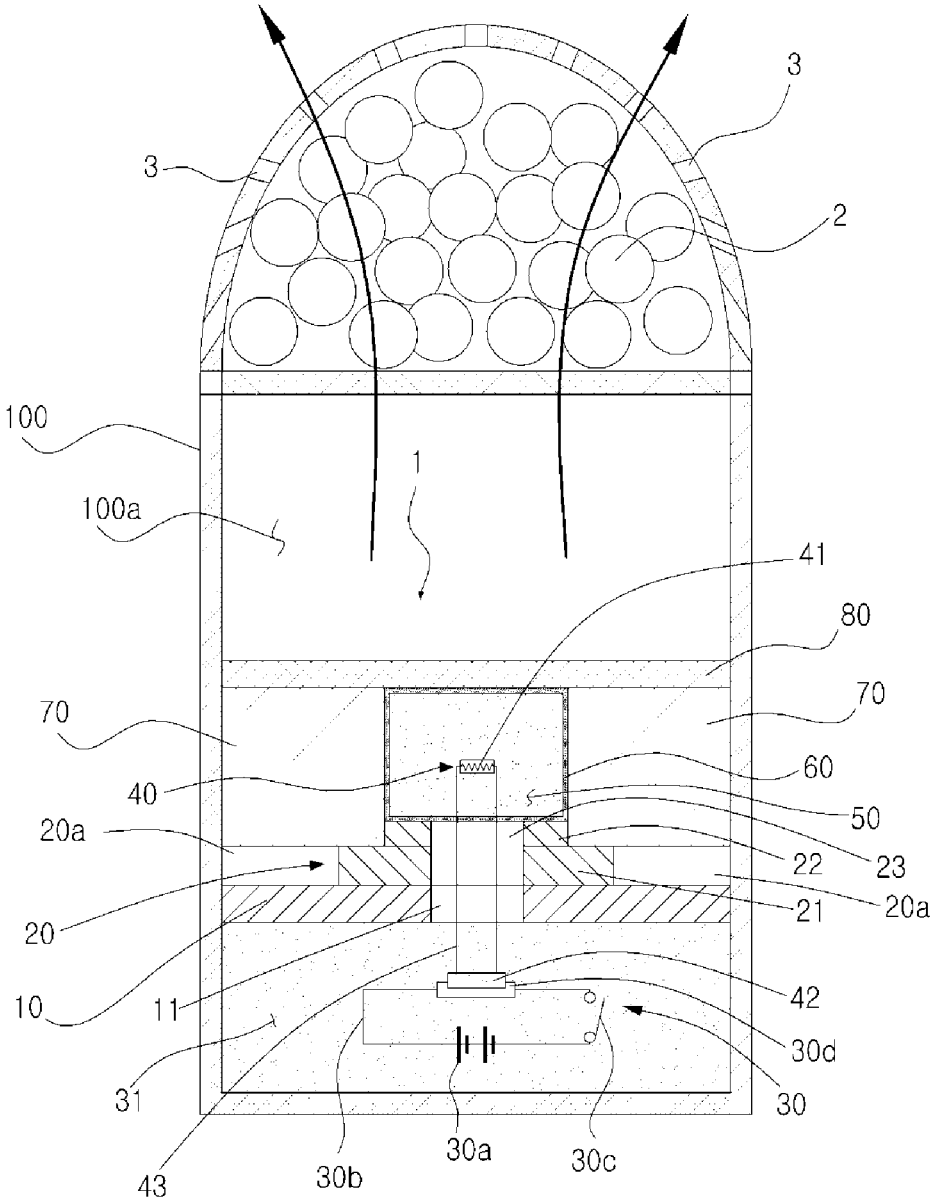
FIG. 5 is a cross-sectional view of a fire extinguishing apparatus using the solid aerosol detonator according to an embodiment of the present invention.

FIG. 5 is a cross-sectional view of a fire extinguishing apparatus using the solid aerosol detonator according to an embodiment of the present invention. The fire extinguishing apparatus using the solid aerosol detonator according to an embodiment of the present invention may be implemented by inserting the solid aerosol detonator 1 into the bottom of the internal space of the enclosure 100, disposing a coolant 2 at the upper part of the fire extinguishing apparatus so that a fire extinguishing gas generated by the solid aerosol detonator passes through the coolant 2 and is then cooled, and forming spray holes 3 in the upper surface of the fire extinguishing apparatus so that the fire extinguishing gas cooled by the coolant 2 is sprayed to the outside.

Accordingly, when a fire extinguishing gas generated by the solid aerosol detonator according to an embodiment of the present invention moves to the upper side along the internal space 100*a* of the enclosure 100, heat included in the fire extinguishing gas is cooled while the fire extinguishing gas passes through the coolant 2.

Thereafter, the cooled fire extinguishing gas may be sprayed to the outside through the plurality of spray holes 3 formed in the upper surface of the enclosure 100.

In this case, the coolant 2 may be a coolant fabricated in a ring form, but is not limited thereto. The coolant may be implemented in various types, and a detailed description thereof is omitted.

As described above, in accordance with the embodiments of the present invention, the solid aerosol detonator and the fire extinguishing apparatus using the same can be detonated using only a fire extinguishing agent of a solid form without using an electronic match or an ignition agent, that is, a material coated on an electrical percussion. Accordingly, there is an advantage in that the combustion action of a solid aerosol can be stably generated because the solid aerosol detonator and the fire extinguishing apparatus using the same are not sensitive to a change in the physical properties and a change in the temperature even after a lapse of a specific time.

Furthermore, a solid aerosol loaded within the fire extinguishing apparatus causes perfect combustion because a sufficient heating temperature is supplied to the second fire extinguishing agent using heat from a fire extinguishing gas generated by the first fire extinguishing agent loaded within the fire extinguishing apparatus. Accordingly, there is an advantage in that a sufficient fire extinguishing gas for extinguishing a fire can be generated.

Furthermore, there is an advantage in that the heat-generating unit capable of heating the fire extinguishing agent loaded within the fire extinguishing apparatus can be protected against an external impact because the heat-generating unit is located within the fire extinguishing apparatus.

Furthermore, there is an advantage in that an internal circuit board or an electric wire within the fire extinguishing apparatus can be prevented from being melted and damaged by heat attributable to the generation of a high-temperature fire extinguishing gas.

Those skilled in the art to which the present invention pertains will understand that the present invention may be implemented in other detailed forms without changing the technological spirit or indispensable characteristics of the present invention. Accordingly, it will be understood that the aforementioned embodiments are illustrative and not limitative from all aspects. The range of right of the present invention is defined by the appended claims rather than the detailed description, and the present invention should be construed as covering all modifications or variations derived from the meaning and scope of the appended claims and their equivalents.

What is claimed is:

1. A solid aerosol detonator inserted into an enclosure of a solid aerosol fire extinguishing apparatus, the solid aerosol detonator comprising:

a first plate configured to partition an internal space of the enclosure, a first through hole being formed at a center of the first plate;

a second plate configured to have a diameter smaller than a diameter of the first plate, seated on a top surface of the first plate and configured to form a specific space between an outer circumferential surface of the second plate and an inner wall of the enclosure, a second through hole being formed at a center of the second plate;

a power supply unit configured to store specific power and located under the first plate;

a heat-generating unit connected to the power supply unit, upward protruded from the second plate through the first through hole and second through hole, supplied with power from the power supply unit, and heated at a specific temperature;

a first fire extinguishing agent configured to surround an outer circumferential surface of the heat-generating unit in such a way as to impregnate a specific portion of the heat-generating unit and detonated at an ignition point or more to generate a fire extinguishing gas;

a sealed member configured to surround an outer circumferential surface of the first fire extinguishing agent; and a second fire extinguishing agent configured to have a ring shape in which a through hole is formed at a center of the second fire extinguishing agent and detonated at an ignition point or more to generate a fire extinguishing gas, the second fire extinguishing agent being seated on the second plate while surrounding an outer circumferential surface of the sealed member, wherein the second plate comprises a seating stage seated on a top surface of the first plate and a coupling stage of a cylindrical shape upward protruded from a central part of the seating stage and inserted into the through hole of the second fire extinguishing agent, and the second through hole is formed at a center of the seating stage and coupling stage so that the seating stage and coupling stage communicate with each other.

2. The solid aerosol detonator of claim 1, wherein the power supply unit comprises:

a battery configured to store the specific power, and a switch connected to the battery and configured to turn on/off an electric current flowing into the heat-generating unit.

3. The solid aerosol detonator of claim 1, wherein the heat-generating unit comprises:

a hot wire or resistant configured to generate heat at the ignition point or more of the first fire extinguishing agent in response to an electric current of a specific intensity or more, a terminal coupled to the power supply unit, and a connection line to which the terminal and the hot wire or resistant are connected.

4. The solid aerosol detonator of claim 1, wherein:

the first fire extinguishing agent and second fire extinguishing agent comprises a solid aerosol filling, and the first fire extinguishing agent is compressed in a form of power having a diameter of 100~1000 mesh and filled into an inside of the sealed member.

5. The solid aerosol detonator of claim 1, wherein the sealed member comprises a sealant comprising one selected from porous films made of non-woven fabric, Korean paper, parchment paper and fabrics.

6. The solid aerosol detonator of claim 1, further comprising a metal mesh network configured to surround the outer circumferential surface of the sealed member.

7. The solid aerosol detonator of claim 1, further comprising a third plate closely attached to a top surface of the second fire extinguishing agent and fixed to an inner sidewall of the enclosure, a mesh structure being formed at a central part of the third plate.

8. The solid aerosol detonator of claim 1, further comprising a heat shield material filled under the first plate in such a way as to surround an outer circumferential surface of the power supply unit.

9. A fire extinguishing apparatus comprising a solid aerosol detonator according to claim 1.

* * * * *